US007559157B2

(12) United States Patent
Polegato Moretti

(10) Patent No.: US 7,559,157 B2
(45) Date of Patent: Jul. 14, 2009

(54) VAPOR-PERMEABLE AND WATERPROOF SOLE FOR SHOES

(75) Inventor: Mario Polegato Moretti, Crocetta del Montello (IT)

(73) Assignee: GEOX S.p.A., Montebelluna (IT)

( * ) Notice: Subject to any disclaimer, the term of this patent is extended or adjusted under 35 U.S.C. 154(b) by 327 days.

(21) Appl. No.: 10/565,541

(22) PCT Filed: Jul. 15, 2004

(86) PCT No.: PCT/EP2004/007894

§ 371 (c)(1),
(2), (4) Date: Jan. 23, 2006

(87) PCT Pub. No.: WO2005/011417

PCT Pub. Date: Feb. 10, 2005

(65) Prior Publication Data

US 2007/0011907 A1 Jan. 18, 2007

(30) Foreign Application Priority Data

Jul. 22, 2003 (IT) ..... PD2003A0166

(51) Int. Cl.
*A43B 7/06* (2006.01)
*A43B 13/12* (2006.01)

(52) U.S. Cl. ..... 36/3 B; 36/30 R

(58) Field of Classification Search ..... 36/3 B, 36/30 R, 11.5, 25 R, 31, 28
See application file for complete search history.

(56) References Cited

U.S. PATENT DOCUMENTS 4,446,633 A * 5/1984 Scheinhaus et al. ..... 36/11.5
4,656,760 A * 4/1987 Tonkel et al. ..... 36/28
4,813,161 A 3/1989 Lesley
5,022,168 A * 6/1991 Jeppson et al. ..... 36/43
5,589,245 A 12/1996 Roell (Continued)

FOREIGN PATENT DOCUMENTS

EP 1 127 505 8/2001

(Continued)

OTHER PUBLICATIONS

U.S. Appl. No. 10/585,085, filed Jun. 30, 2006, Polegato Moretti, et al.

(Continued)

*Primary Examiner*—Ted Kavanaugh
(74) *Attorney, Agent, or Firm*—Oblon, Spivak, McClelland, Maier & Neustadt, P.C.

(57) ABSTRACT

A vapor-permeable and waterproof sole for shoes, particularly but not exclusively for open shoes such as sandals, sabots and the like. The sole includes a lower element, on which a tread is integrated in a downward region, the lower element chosen between an element that is vapor-permeable at least in an upward region and a perforated element, and an upper vapor-permeable and/or perforated element further. A vapor-permeable and waterproof membrane is interposed between the lower element and the upper element, the membrane and the lower element and the upper element are joined hermetically in the perimetric regions of mutual contact, and at least one vapor-permeable comfort layer, which composes the lower element and/or the upper element and is made of three-dimensional fabric, forms a ventilation gap.

19 Claims, 3 Drawing Sheets

U.S. PATENT DOCUMENTS

| | | | | |
|---|---|---|---|---|
| 5,746,013 | A | 5/1998 | Fay, Sr. | |
| 6,389,711 | B1 * | 5/2002 | Polegato | 36/3 R |
| 6,655,048 | B2 | 12/2003 | Moretti | |
| 6,874,251 | B2 | 4/2005 | Moretti | |
| 6,986,215 | B2 | 1/2006 | Moretti | |
| 2001/0003875 | A1 | 6/2001 | Moretti | |
| 2002/0157278 | A1 | 10/2002 | Moretti | |

FOREIGN PATENT DOCUMENTS

| | | |
|---|---|---|
| JP | 06296507 | 10/1994 |

OTHER PUBLICATIONS

U.S. Appl. No. 10/565,541, filed Jan. 23, 2006, Polegato Moretti.
U.S. Appl. No. 10/565,541, Jan. 23, 2006, Moretti.

* cited by examiner

VAPOR-PERMEABLE AND WATERPROOF SOLE FOR SHOES

TECHNICAL FIELD

The present invention relates to a vapor-permeable and waterproof sole for shoes, particularly but not exclusively for open shoes such as sandals, sabots and the like.

BACKGROUND ART

The present invention also relates to a shoe provided with said sole.

It is known that the comfort of a shoe is linked not only to correct anatomical fit but also to correct outward transmission of the water vapor formed inside the shoe due to sweating, in order to avoid the "damp foot" phenomenon.

This permeation of the water vapor, however, must not compromise the waterproofness of the shoe, and therefore solutions have been studied which entrust vapor permeation to the upper or to the sole.

As regards the upper, there are shoes with an upper made of vapor-permeable and waterproof material.

However, this type of shoe does not effectively solve the problem of vapor permeation: the "damp foot" problem arises from the fact that during sweating the sweat evaporates from the foot and cools it. If evaporation is prevented, the sweat condenses and leaves the foot damp.

Most of the sweat of the foot is originated at the interface between the sole of the foot and the sole of the shoe, and it is evident that the sweat formed here is unable to evaporate, thus condensing on the plantar element on which the foot rests. Only a minimal part of the sweat evaporates through the upper, even if said upper is reduced to a minimum.

Solutions to the problem are provided by vapor-permeable and waterproof soles, which accordingly allow permeation of the sweat generated at the sole of the foot.

One of these solutions is disclosed in U.S. Pat. No. 5,044,096 and EP-0382 904 by the same Applicant and consists in dividing the sole into two layers with through holes and in interposing a membrane that is impermeable to water and vapor-permeable and is joined perimetrically and hermetically to the two layers.

Variations of this solution are disclosed in subsequent patents, all of which are in any case centered on dividing the sole into two layers, with the interposition of a waterproof and vapor-permeable membrane.

In view of the fact that most of the sweat of the foot is generated at the interface between the sole of the foot and the sole of the-shoe, the "damp foot" problem is considerable even in open shoes, such as sandals, sabots, mules for seaside use, et cetera.

These kinds of open shoe are generally constituted by an upper that only partially wraps around the foot insertion region and by a multilayer sole.

With reference from the top downwardly, such multilayer sole comprises a first layer, which makes direct contact with the foot and is generally made of leather or synthetic material.

If such layer is made of non-vapor-permeable material (such as for example mules for seaside use), sweat condenses immediately, leaving an almost instantaneous feeling of dampness at the foot.

If the layer is made of a vapor-permeable material that has some absorbent power, the foot remains dry until such layer becomes impregnated with sweat.

Below the first layer there is a second layer, which is generally contoured anatomically and is generally made of an expanded or compact material, such as polyurethane, cork, wood, expanded rubbers, et cetera.

Finally, there is a tread, which makes contact with the ground and can be made of synthetic material (rubber, polyurethane), natural material (leather), or mixed material.

The various layers are coupled by means of adhesives or, as an alternative, by injection-molding the various layers of polymeric material over the others.

Below the second layer, if it is made of soft or low-consistency material, there is a supporting layer, so as to provide a rigidity and hardness that allow to glue the flaps of the upper between the tread and said supporting layer.

For open shoes that must have a certain comfort degree, it is important that the supporting plantar element (or insole) be sufficiently soft and anatomically contoured.

This leads to the need to use, for the second layer (and optionally also for the third layer), soft materials, such as "sponges" or the like, in order to accommodate the foot and surround its sole.

However, this surrounding prevents correct circulation of the air between the skin of the foot and the plantar element on which the foot rests, leading to almost immediate condensation, which cannot be dissipated through the sole.

Furthermore, the foot transfers heat to the surrounding material, which retains it and produces a "padding" effect that further overheats the foot.

If a rigid plantar element were used, the foot would have fewer points of contact with said plantar element, allowing better ventilation and optimum cooling of the foot.

Therefore, as the rigidity of the plantar element increases (and therefore the comfort of the shoe decreases), the freshness of the foot increases. Vice versa, the lower the rigidity and hardness of the plantar element (and therefore the greater the comfort degree of the shoe), the stronger the "sweaty foot" effect.

Moreover, as already mentioned, lack of vapor permeation of the layers below the foot leads to almost immediate condensation on the sole of the foot. This lack of permeation is due both to the type of materials used (particularly for the tread) and to any films of adhesive that join the various layers.

The causes of the "sweaty foot" effect in open shoes provided with an anatomically contoured soft plantar element can therefore be summarized in three aspects: the surrounding of the foot by the anatomically contoured layer, which prevents correct recirculation of air between the sole and the plantar element; the "padding" effect caused by said surrounding; and the lack of permeation of the sweat in the direction of the tread.

DISCLOSURE OF THE INVENTION

The aim of the present invention is to provide a vapor-permeable and waterproof sole for shoes, particularly but not exclusively for open shoes such as sandals, sabots and the like, that allows to solve the problems met in known types.

Within this aim, an important object of the present invention is to provide a vapor-permeable and waterproof sole for shoes, particularly but not exclusively for open shoes such as sandals, sabots and the like, that is comfortable both in terms of fit and of vapor permeation of the sole of the foot.

Another important object of the present invention is to provide a vapor-permeable and waterproof sole for shoes, particularly but not exclusively for open shoes such as sandals, sabots and the like, that while maintaining characteristics of comfort for the foot reduces the padding effect with respect to the foot.

Another object of the present invention is to provide a vapor-permeable and waterproof sole for shoes, particularly but not exclusively for open shoes such as sandals, sabots and the like, that allows correct recirculation of air between the skin of the sole of the foot and the supporting plantar element.

Another object of the present invention is to provide a shoe with a vapor-permeable and waterproof sole, particularly but not exclusively of the open type such as sandals, sabots and the like, that is comfortable both in terms of fit and of vapor permeation of the sole of the foot.

This aim and these and other objects that will become better apparent hereinafter are achieved by a vapor-permeable and waterproof sole for shoes, particularly but not exclusively for open shoes such as sandals, sabots and the like, characterized in that it comprises the following combination of elements:

- a lower element, on which a tread is integrated in a downward region, said lower element being selected between an element that is vapor-permeable at least in an upward region and a perforated element;
- an upper vapor-permeable and/or perforated element;
- a vapor-permeable and waterproof membrane, interposed between said lower element and said upper element, said membrane and said lower and upper elements being joined hermetically in the perimetric regions of mutual contact,
- at least one vapor-permeable comfort layer, which is included in said lower element and/or in said upper element and is made of three-dimensional fabric, forming a ventilation gap.

Advantageously, the invention includes a shoe provided with said sole.

BRIEF DESCRIPTION OF THE DRAWINGS

Further characteristics and advantages of the invention will become better apparent from the description of some preferred but not exclusive embodiments thereof, illustrated by way of nonlimiting example in the accompanying drawings, wherein.

WAYS TO CARRYING OUT THE INVENTION

Figure 1:
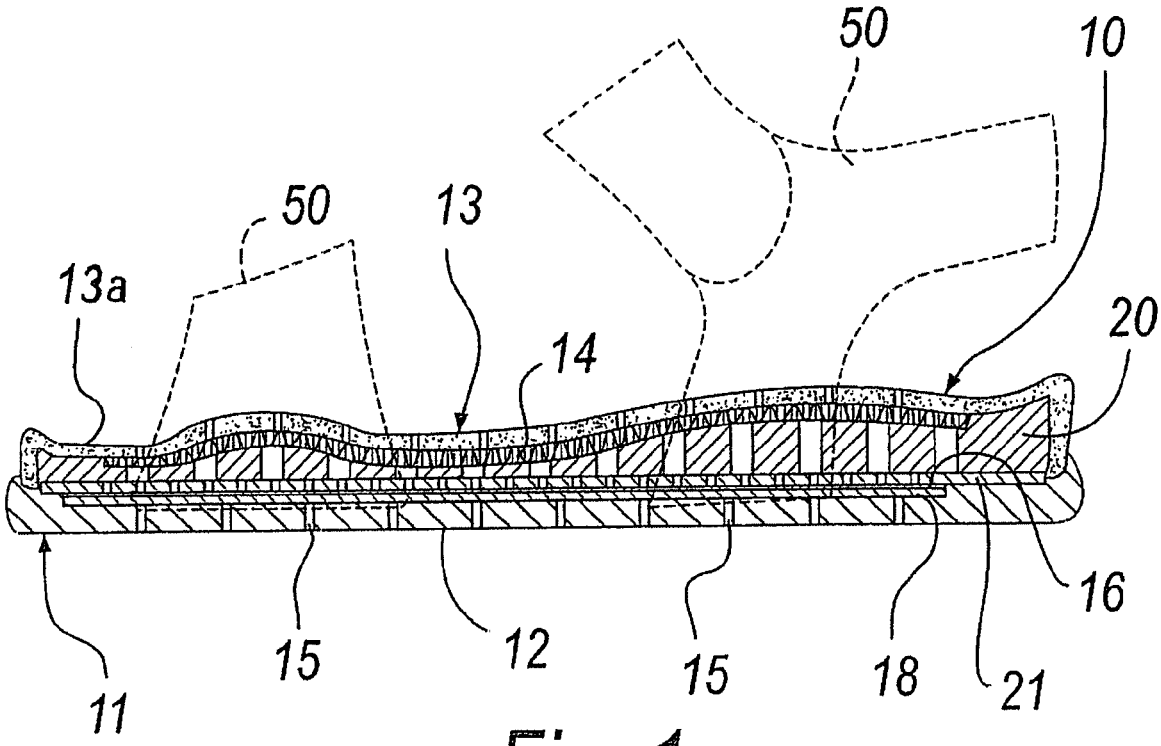
FIG. 1 is a longitudinal sectional view of an open shoe of the sandal type, using a first embodiment of a sole according to the invention.
Figure 2:
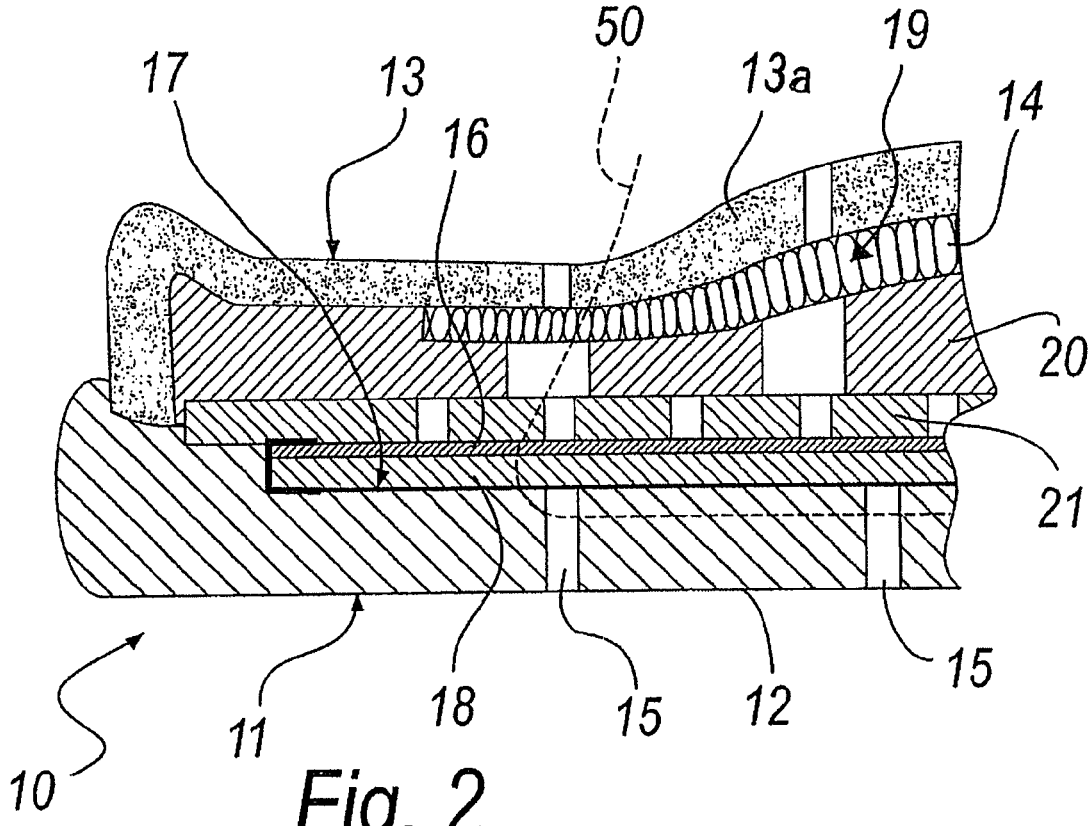
FIG. 2 is an enlarged-scale view of FIG. 1.

With reference to the figures, a first embodiment of the sole according to the invention is generally designated by the reference numeral 10.

Said sole 10 comprises a lower element 11, on which a tread 12 for contact with the ground is integrated in a downward region, and an upper element 13, which in this embodiment is composed of vapor-permeable layers and perforated layers, as will become better apparent hereinafter.

A vapor-permeable comfort layer 14, made of a three-dimensional fabric described in greater detail hereinafter, is provided between said vapor-permeable layers and said perforated layers.

The lower element 11, in this embodiment, has a plurality of through holes 15 that are substantially perpendicular to the extension of said sole.

A vapor-permeable and waterproof membrane 16 is interposed between the lower element 11 and the upper element 13.

The membrane 16, the lower element 11 and the upper element 13 are joined hermetically in the perimetric regions of mutual contact in a per se known manner.

In particular, on the upper part of the lower element 11 there is a substantially flat seat 17, inside which the membrane 16 is arranged.

A protective element 18, constituted by a layer of hydrolysis-resistant, water-repellent, vapor-permeable or perforated material, is coupled to said membrane at the face that is directed toward the lower element 11.

Said protective element 18 has the same plan dimensions as the membrane 16.

The area occupied in plan view by the membrane 16 is the same area occupied by the through holes formed through the lower element 11 and the upper element 13.

The upper element 13 is arranged substantially above the membrane 16 and consists of multiple layers, all of which are vapor-permeable or perforated, as described hereinafter.

The upper layer, of said upper element 13 consists of a first layer 13*a* made of vapor-permeable and/or perforated material, such as for example perforated leather.

Below said first layer 13*a* a second layer is provided, which coincides with, or is the very vapor-permeable comfort layer 14, made of a three-dimensional fabric.

Said three-dimensional fabric forms a ventilation gap 19, which is deformed only partially under the weight of a person, avoiding total collapse of said gap and thus always maintaining a ventilation space.

Openwork fabrics of the mesh type, known as "mesh" in shoe-making jargon, are produced and used as vapor-permeable uppers or internal linings, particularly in sports shoes.

Fabrics that combine a needle-punched element with the mesh fabric and are known as "air mesh" are known as a derivative of said mesh fabrics.

In this embodiment, the three-dimensional fabric of said vapor-permeable comfort layer 14 is of the air mesh type or is in any case a needle-punched fabric of suitable strength.

Below said vapor-permeable comfort or second layer 14 a third layer 20 is provided, which is contoured anatomically with respect to the sole of the foot and is made for example of expanded material that is perforated substantially at right angles to the extension of the sole 10.

In particular, the vapor-permeable comfort layer 14 has smaller plan dimensions than said third layer 20 and is arranged inside a complementary flat cavity formed centrally with respect to said third layer.

In this embodiment, a fourth layer 21 is provided below the third layer 20 and is perforated at right angles to the extension of the sole: said fourth layer 21 is necessary when the upper layers are unable to ensure the correct rigidity or hardness of the entire upper element 13 and can therefore be optional in other embodiments.

In different embodiments (not shown in the figures), said fourth layer 21 can be vapor-permeable instead of perforated and can also be arranged in other positions, such as for example between the second vapor-permeable comfort layer 14 and the third layer 20.

Furthermore, said fourth layer 21, if provided so as to protrude with respect to the second layer 14 and the third layer 20, can be used to allow any external stitched seams.

The leather of the first layer 13*a* is directed outwardly so as to fit the sole by wrapping around the edge of the second layer 14 or optionally also wrapping around the lateral edge of the third layer 20, as in the case of so-called "fussbett" plantar elements.

Figure 3:
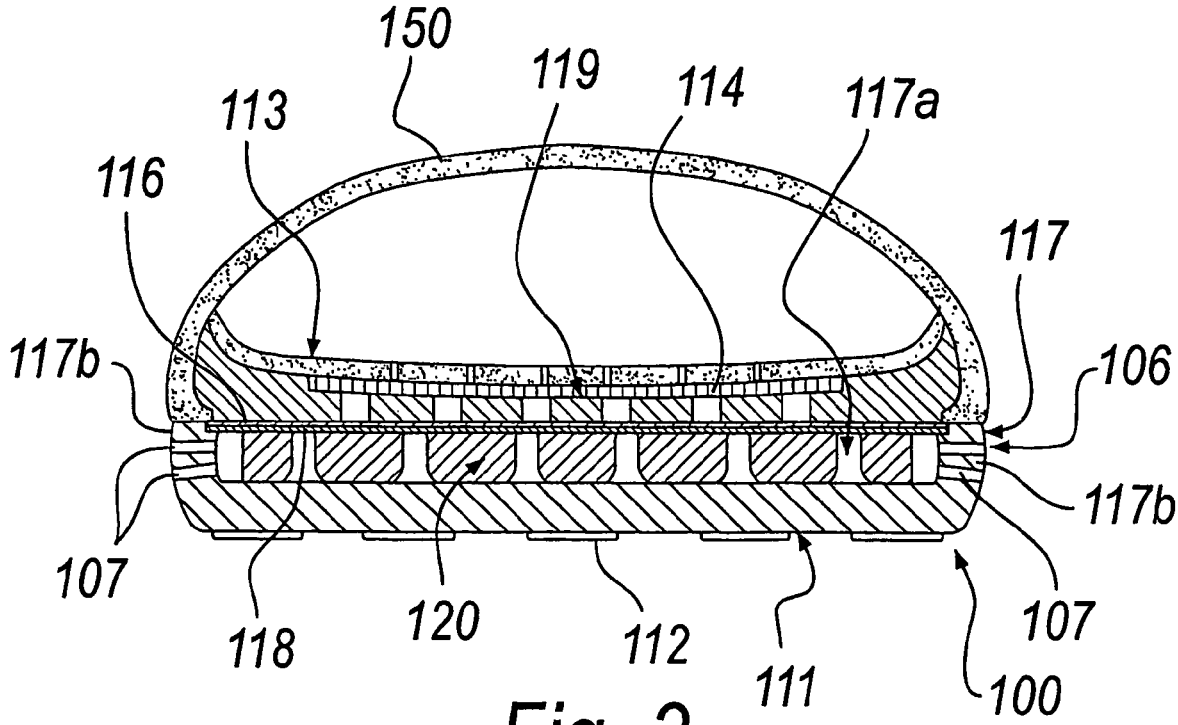
FIG. 3 is a transverse sectional view of an open shoe that uses a second embodiment of a sole according to the invention.

A second embodiment of the sole according to the invention is shown in FIG. 3 and is designated by the reference numeral 100.

Like the first described embodiment, said sole 100 comprises a lower element 111, on which a tread 112 for contact with the ground is integrated in a downward region, and an upper element 113.

Said upper element 113 is composed of a plurality of layers, similar to those of the sole 10, shown in the first embodiment.

A vapor-permeable comfort layer 114 is provided between said layers and is made of a three-dimensional fabric that forms a ventilation gap 119 which, under the weight of a person, undergoes only a partial deformation, avoiding complete collapse of said gap and thus always maintaining a ventilation space.

In this embodiment also, said three-dimensional fabric is of the air mesh type or is in any case a needle-punched fabric.

A vapor-permeable and waterproof membrane 116 is interposed between the lower element 111 and the upper element 113 and is sealed perimetrically to the sole 100.

In this second embodiment, along the plan extension of the upper part of the lower element 111 there is a portion 117 that is provided with lateral venting elements 106 between the outside of the sole 100 and the inside of said portion 117.

Said lateral venting elements 106 are functionally connected to the membrane 116.

In particular, in this second embodiment, said portion 117 has, in its central part, a hollow region 117*a* that is delimited perimetrically by edges 117*b*, on which said lateral venting elements 106 are provided; said venting elements are constituted by through venting channels 107 that functionally connect the inside of the hollow region 117*a* and the outside of the sole 100.

A layer-like element 120 that is structured like a lattice, forms cavities and is perforated substantially at right angles to the extension of the sole is arranged inside said hollow region 117*a*.

Figure 4:
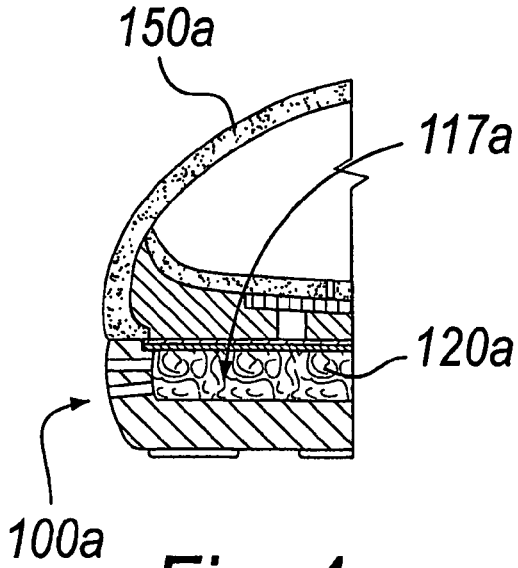
FIG. 4 is a transverse sectional view of a portion of an open shoe that uses a variation of the second embodiment of the sole of FIG. 3.

A variation of said second embodiment 100, shown in FIG. 4 and designated by the reference numeral 100*a*, has a vapor-permeable element 120*a* instead of the latticed layer-like element 120.

Figure 5:
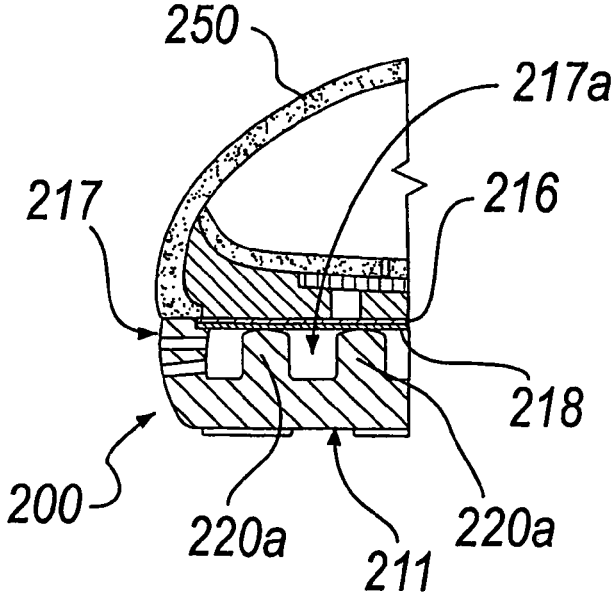
FIG. 5 is a transverse sectional view of a portion of an open shoe that uses a third embodiment of a sole according to the invention.

A third embodiment of the sole according to the invention, which is a variation with respect to said second embodiment, is shown in FIG. 5 and designated by the reference numeral 200.

In said third embodiment, protrusions 220*a* extend substantially at right angles to the extension of the sole from the inside of the hollow region (now designated by the reference numeral 217*a*) formed in the central part of the upper portion 217 of the lower element 211 and form a lattice-like structure that forms cavities.

Said protrusions 220*a* have a height that is substantially equal to the depth of said hollow region 217*a*.

The protective element 218 of the vapor-permeable and waterproof membrane 216 is arranged so as to rest on the protrusions 220*a*.

Figure 6:
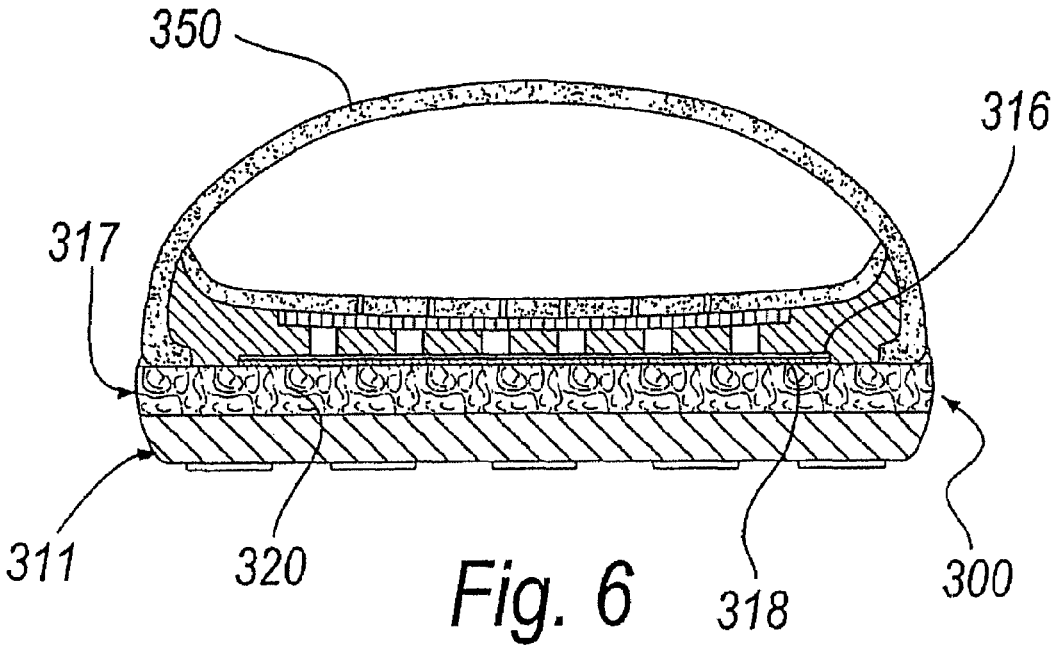
FIG. 6 is a transverse sectional view of a portion of an open shoe that uses a fourth embodiment of a sole according to the invention.

A fourth embodiment of the sole according to the invention, which is a variation with respect to said second embodiment, is shown in FIG. 6 and is designated by the reference numeral 300.

In this fourth embodiment, the upper portion (now designated by the reference numeral 317) of the lower element 311 is constituted by a corresponding vapor-permeable layer-like element 320, which lies along the entire transverse extension of the upper part 317; in this case, the lateral venting elements are provided by the vapor-permeable layer-like element 320 proper (the element 320 is vapor-permeable both vertically and horizontally).

Above the vapor-permeable layered element 320 there is the membrane 316, with the protective element 318.

Figure 7:
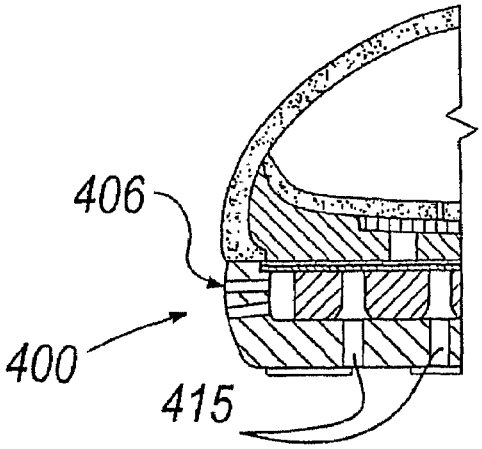
FIGS. 7, 8 and 9 are transverse sectional views of portions of open shoes that use variations with respect to the preceding figures.
Figure 8:
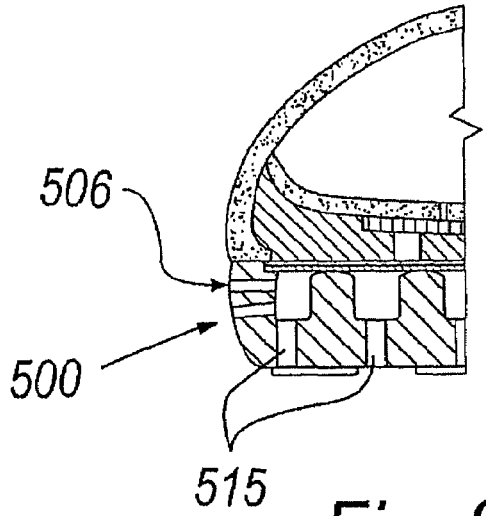
Figure 9:
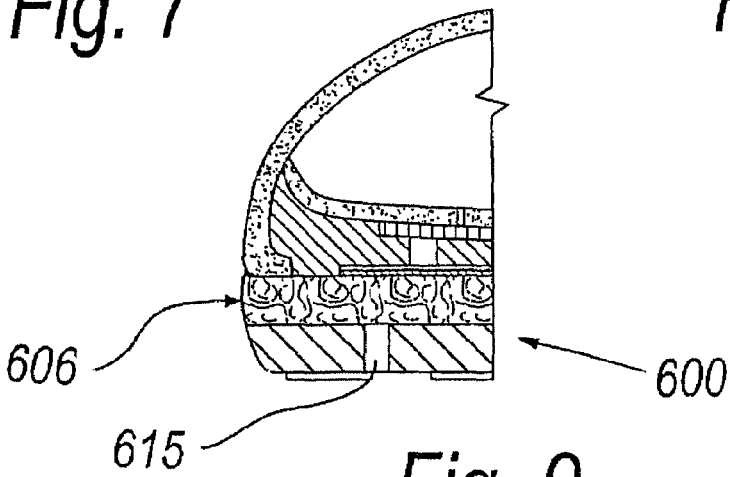

Different embodiments of the soles 100, 200, 300 are designated respectively in FIGS. 7, 8 and 9 by the reference numerals 400, 500, 600. Said figures show a combination of lateral venting elements 406, 506, 606 (which are different depending on the respective variation) and of holes, respectively 415, 515, 615, that pass through the tread.

Other variations (not shown in the figures) can include other vapor-permeable comfort layers made of three-dimensional fabric, which are arranged for example directly below the main vapor-permeable comfort layer already described or in any case depending on the requirements of optimum modulation of the hardness of the sole.

The invention further provides a shoe formed with a sole thus described.

The proposed figures are sectional views of shoes of the sandal type, which use the soles thus described; in said figures, the upper of the shoes is designated by the reference numeral 50, 150, 150*a*, 250, 350 respectively. The flaps of said uppers are coupled in a known manner to the respective soles.

The mutual fixing of the various layers and elements of the soles thus described can include spot adhesive bonding, such as to avoid forming layers of adhesive on the vapor-permeable or perforated layers that would block the outflow of sweat and the passage of air.

Said fixing can also be achieved by means of merely perimetric gluing (therefore outside the area occupied by the membrane and by the various holes), by means of stitched seams, heat-sealing with thermoformation, or other known types of systems.

In practice it has been found that the invention thus described solves the problems noted in known types of vapor-permeable and waterproof soles; in particular, the present invention provides a vapor-permeable and waterproof sole for shoes, particularly but not exclusively for open shoes such as sandals, sabots and the like, that allows optimum vapor permeability of the sole of the foot together with a comfortable fit.

The present invention in fact provides a sole with a soft plantar element that is obtained by means of a three-dimensional fabric of the air mesh type, which allows optimum ventilation between the skin of the sole of the foot and the plantar element.

Moreover, said three-dimensional fabric avoids the padding effect caused by the surrounding arrangement, since it does not retain heat.

Furthermore, the vapor-permeable structure allows effective vapor permeation and venting of the sweat in a downward direction, which is closed by the tread; the waterproof membrane prevents the dirt and moisture present on the ground from being transmitted to the sole of the foot, and at the same time, by being vapor-permeable, allows the sweat to permeate.

If the tread is not perforated vertically or laterally, it is possible to provide a sole that is vapor-permeable in a downward direction simply due to the fact that the lower element can have, in an upward region, a vapor-permeable layer that is localized between said tread and the vapor-permeable and waterproof membrane. In this manner, venting occurs laterally through said vapor-permeable layer.

In practice, venting occurs because the lower element is either constituted by an element that is vapor-permeable at least in an upward region, or is constituted by a perforated (and optionally also vapor-permeable) element.

The invention thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. PD2003A000166 from which this application claims priority are incorporated herein by reference.

The invention claimed is:

1. A vapor-permeable and waterproof sole for shoes, comprising:

a lower element, on which a tread is integrated in a downward region, said lower element being selected among an element that is vapor-permeable at least in an upward region and a perforated element;

an upper vapor-permeable and/or perforated element, said upper element including:

a first layer for contact with the sole of the foot that fits said sole and that is made of vapor-permeable and/or perforated material;

a second layer that is constituted by at least one vapor-permeable comfort layer arranged below said first layer and made of a three-dimensional fabric and forming a ventilation gap; and a third layer arranged below said vapor-permeable comfort layer; and a vapor-permeable and waterproof membrane, interposed between said lower element and said upper element, said membrane and said lower element and said upper element being joined hermetically in the perimetric regions of mutual contact.

2. The sole for shoes according to claim 1, said third layer is contoured anatomically with respect to the sole of the foot and being vapor-permeable and/or perforated, said vapor-permeable comfort layer having smaller plan dimensions than said third layer and being arranged inside a complementary flat cavity formed centrally with respect to said third layer.

3. The sole for shoes according to claim 2, wherein said lower element and said upper element are provided fixed by spot gluing or perimetric gluing of various component layers.

4. The sole for shoes according to claim 2, further comprising a fourth perforated or vapor-permeable layer for modulating hardness of said sole and provided below said third layer.

5. The sole for shoes according to claim 2, wherein said first layer is made of perforated leather.

6. The sole for shoes according to claim 2, wherein said third layer is made of expanded material that is perforated substantially at right angles to an extension of said sole.

7. The sole for shoes according to claim 2, wherein said first layer is folded outwardly so as to wrap around an edge of said second layer.

8. The sole for shoes according to claim 2, wherein said first layer is folded outwardly so as to wrap around a lateral edge of said third layer.

9. The sole for shoes according to claim 2, wherein said three-dimensional fabric is of air mesh.

10. The sole for shoes according to claim 2, wherein said three-dimensional fabric is of needle-punched.

11. The sole for shoes according to claim 1, wherein along a plan extension of an upper part of said lower element a portion having lateral venting elements between the outside of said sole and the inside of said portion is provided, said lateral venting elements being functionally connected to said membrane.

12. The sole for shoes according to claim 11, wherein said portion has, in a central part thereof, a hollow region, which is delimited perimetrically by edges, said lateral venting elements being formed in said edges and being constituted by through venting channels for functional connection between an inside part of said hollow region and an outside part of said sole.

13. The sole for shoes according to claim 12, wherein a layer latticed element is arranged inside said hollow region, forms cavities, and is perforated substantially at right angles to an extension of the sole.

14. The sole for shoes according to claim 12, further comprising a vapor-permeable element arranged inside said hollow region.

15. The sole for shoes according to claim 12, further comprising protrusions that extend from the inside part of said hollow region substantially at right angles to an extension of said sole, said protrusions forming a lattice shaped structure that forms cavities, said protrusions having a height that is substantially equal to a depth of said hollow region.

16. The sole for shoes according to claim 12, wherein said upper portion of said lower element is constituted by a corresponding vapor-permeable layer-like element that extends along an entire transverse extension of said upper part.

17. The sole for shoes according to claim 1, wherein said lower element has a plurality of through holes that are substantially perpendicular to an extension of said sole.

18. The sole for shoes according to claim 1, further comprising a protective element coupled to said membrane at the face that is directed toward said lower element and is constituted by a layer of a material that is resistant to hydrolysis, water-repellent, vapor-permeable or perforated, said protective element having the same plan dimensions as said membrane.

19. A shoe, comprising a sole according to claim 1.

* * * * *